United States Patent [19]

Sullivan et al.

[11] 4,333,246

[45] Jun. 8, 1982

[54] APPARATUS AND METHOD FOR DRYING CAN CLOSURES

[75] Inventors: Richard W. Sullivan, Denver; Tuan A. Nguyen, Broomfield, both of Colo.

[73] Assignee: Ball Corporation, Muncie, Ind.

[21] Appl. No.: 195,974

[22] Filed: Oct. 10, 1980

[51] Int. Cl.[3] ..... F26B 3/04; F26B 25/02

[52] U.S. Cl. ..... 34/23; 34/33; 34/150; 34/206; 34/236; 193/38; 198/721; 427/372.2

[58] Field of Search ..... 198/721, 722; 193/38, 193/41; 34/150, 236, 206, 20, 23, 33; 118/58, 62; 427/372.2

[56] References Cited

U.S. PATENT DOCUMENTS

| | | | |
|---|---|---|---|
| 1,192,705 | 7/1916 | Taliaferro et al. | 193/38 |
| 1,630,345 | 5/1927 | Lanza | 193/38 |
| 3,739,489 | 6/1973 | Macone | 34/150 |
| 3,977,670 | 8/1976 | Tsuruta et al. | 34/150 |

*Primary Examiner*—Larry I. Schwartz
*Attorney, Agent, or Firm*—Nicholas T. Bokides

[57] ABSTRACT

The present invention discloses a way of separating and treating the covered surfaces of stacked articles in abutting face-to-face contact. It is particularly applicable to stacked planar articles, those having a relatively small width dimension and at least two substantially parallel surfaces in abutting contact, such as metal beverage container closures. The articles are pushed through a curvilinear path defined by a constant width trackwork of a herein specified design, allowed to pivot on the portions of the articles in proximity to the shorter radius whereby fan-like separation of the portions in proximity to the longer radius occurs, and treating medium, such as heated air, is directed toward the separated portions. Greater uniformity in treatment may be obtained by rotating the articles, at least once, as they traverse the curvilinear path. A preferred embodiment designed to dry the sealant on metal beverage container closures is disclosed herein.

23 Claims, 7 Drawing Figures

APPARATUS AND METHOD FOR DRYING CAN CLOSURES

TECHNICAL FIELD

The present invention relates to a method of separating a major portion of the covered surfaces of articles which are in a stack and, more particularly, to the drying or curing of coating compositions, including sealants, on container closures and the like wherein said closures are arranged in a stacked relationship.

BACKGROUND OF THE PRIOR ART

Closures for metal beverage containers are generally of a circular shape with a flanged perimeter. The flanged perimeter is used in attaching the closure to a can body through a seaming operation. To aid the integrity of the seal thus formed between the can body and the closure, it is a common practice to apply a bead of sealant within the flanged perimeter during manufacture of the closure.

One problem which arises in this manufacturing operation is the curing or drying of such sealants. To facilitate handling of the closures after the application of a sealant, the closures are often accumulated into a columnar stack and transported to the next operation through appropriate trackwork. When the closures are in such a stacked condition, it is difficult or impossible to direct energy waves such as heat or moving air across the sealant to accelerate the drying process. The flange, in combination with the adjacent stacked closure, effectively shields the sealant from outside influences.

When the sealant is of the solvent-based type, this is not a severe problem. Even in the stacked condition, the volatile solvent quickly evaporates and within 24 to 48 hours the sealant is acceptably dry for application of the closure to a can body.

Recently there has been an increased interest in the use of water-based sealants in the container industry. These sealants present much greater difficulty in quick and effective drying. Very slow drying takes place and it may take up to 10 days for the sealant to dry to an acceptable state for application of the closure to a can body.

Prior to the present invention, the achievement of practical drying times for water-based sealants required complicated apparatus to unstack the closures and transport them, one at a time, through a hot air blowing station thereby allowing streams of air to directly impinge the sealant and effectively dry it. Apparatus used in such an operation has many drawbacks, mainly due to its complexity, high cost, and expansive floor space requirements.

BRIEF SUMMARY OF THE INVENTION

The present invention provides a simple way to expose the covered surfaces of stacked articles and as applied to closures, to provide direct access of the sealant thereon to a moving stream of air. Although the present invention is particularly suitable to the drying of closures, it is to be appreciated that it has much broader application in various situations where the separation of stacked articles is desired for drying, treating or other purposes.

In accordance with the present invention, a portion of the covered surfaces of a stack of articles is exposed by pushing the stack through a first curvilinear path and allowing said articles to pivot on the portions of said covered surfaces proximate to the focus of said curvilinear path whereby the portion of said covered surfaces distal to said focus will separate in a fan-like manner. Where the complete surface of said article is to be exposed, the above operation is repeated using a second curvilinear path of a different direction that the first curvilinear path or the articles may be rotated while traversing the curved path. In effect, the orientation of the article is maintained relative to the curvilinear direction of travel at a constant. This results in the portion of the articles traversing the longer outer curve separating from adjacent articles while the portion of the articles traversing the shorter inner curve remain in contact thereby forming a fan-like pattern around the path. This may generally be accomplished by suitable track means and an indexing or other type of pushing means located at the beginning of said track means.

Essentially any series of uniform semi-rigid or rigid articles in a stacked relationship which can be pushed and guided through a curved path while maintaining a fixed orientation relative to the direction of travel therethrough can be operated on in accordance with the present invention. Stacked planar articles, those having at least two substantially parallel opposing surfaces in abutting face-to-face contact and a relatively small width dimension, are especially suited for treatment hereunder due to the large portion of the abutting surfaces which are inaccessible.

In the application of the present invention to the drying of closures, suitable track means are constructed to confine the closures to a predetermined path through a drying station. In one arrangement, said predetermined path has a number of reversing curves. An air stream, which is preferably heated, is directed across these curves. The closures are then pushed through the curves by a pushing means situated at the beginning of said track means. As the closures traverse a curve, the portion of the closures traversing the longer outer curve separate in a fan-like manner allowing direct access to the sealant by the air stream. In the traverse of two curves at opposite directions, the complete perimeter of the closure is made accessible to streams of heated air. Greater uniformity in drying may be accomplished by rotating the closures through at least one complete revolution as a curve is traversed.

Accordingly, it is an object of this invention to provide a way of separating a portion of an article from adjacent portions of similar articles where said articles are in a stack.

It is another object of this invention to provide a method and apparatus for exposing and treating the unexposed surfaces of articles which are in a stack.

It is a further object of this invention to provide a method and apparatus for drying or curing coatings on the unexposed surface of articles which are stacked.

It is a further object of the present invention to provide a simple and reliable way to quickly dry water-based sealant on beverage closures.

DETAILED DESCRIPTION OF THE INVENTION

Figure 1:
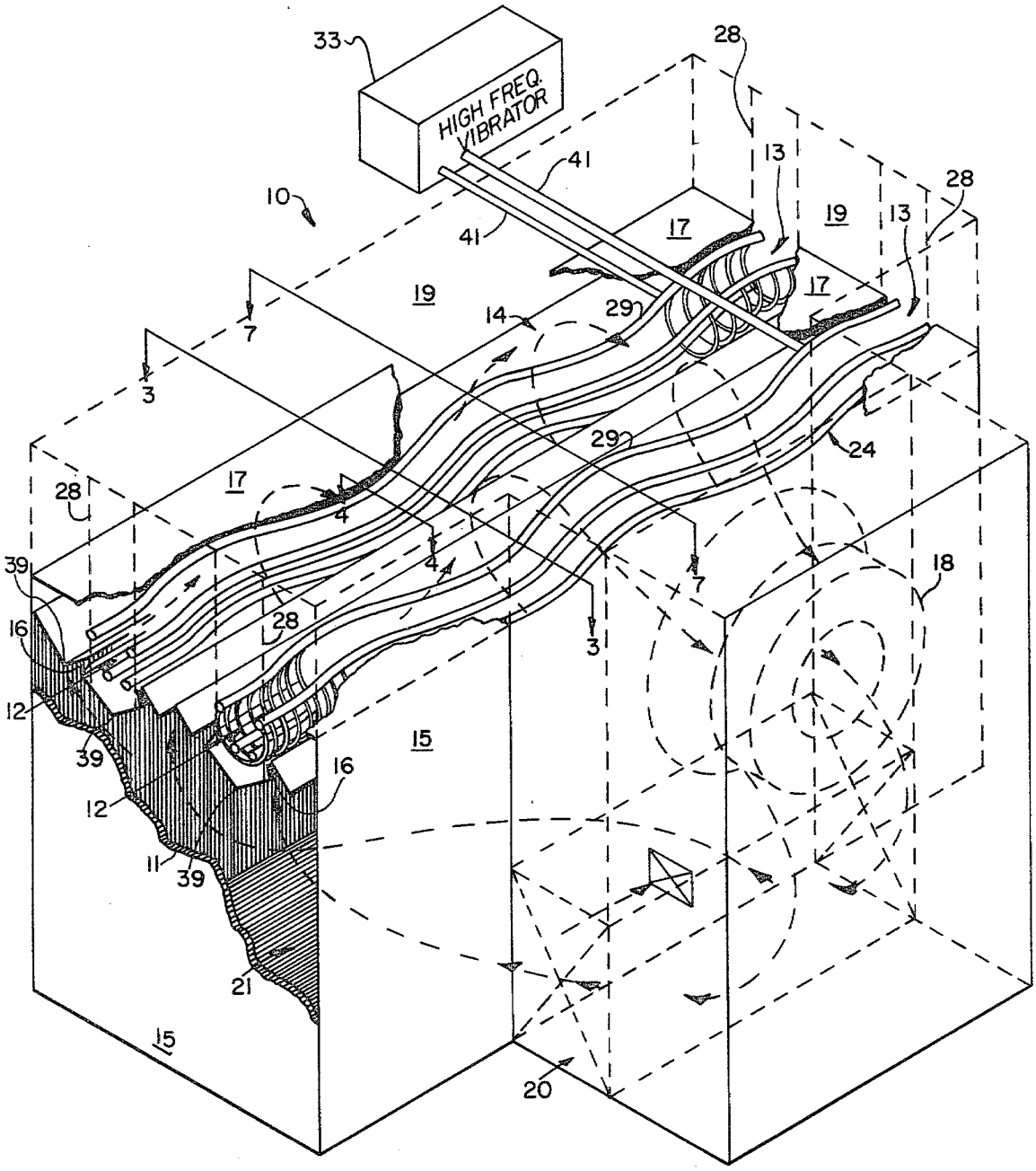
FIG. 1 is an asymmetric drawing of a closure dryer constructed in accordance with the present invention.

While this invention is susceptible to embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

Referring to FIG. 1, a beverage closure dryer constructed in accordance with the present invention is generally referenced by the numeral 10. The dryer has an enclosure 15 with insulated walls 11; two entrances 12 and two exits 13; two trackworks 14 and 24 between said entrances and exits, each of said trackworks having four rails 29, the ends of which are retained in rectangular openings 28 in enclosure 15; four linear nozzles 16, one on each side of each trackwork; a planar baffle 17, extending outwardly from the top rails of said trackworks; a high frequency vibrator 33 attached to trackworks 14 and 24 through extensions 41; and a fan 18 which removes air from exhaust compartment 19 above baffle 17 and forces said air through heater 20 into hot air receiving compartment 21 and through linear nozzles 16 which direct said air to trackworks 14 and 24.

Figure 2:
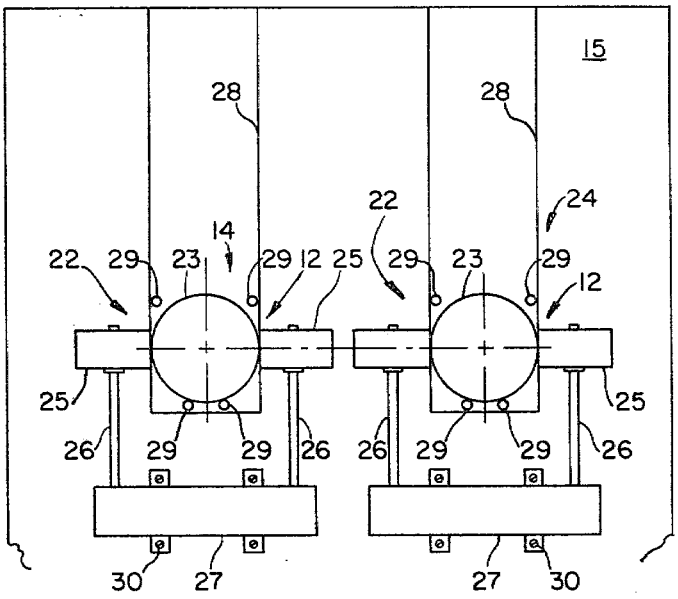
FIG. 2 is an end view of the entrance to the closure dryer.

Entrances 12 to closure dryer 10 are better shown in FIG. 2, which is an end view of the dryer. The ends of rails 29 rest securely in rectangular openings 28. A pushing means for each trackwork must be located upstream of the dryer such as resilient wheel drive 22, which is mounted at each dryer entrance 12. Each of the drives comprises two resilient wheels 25 mounted on drive shafts 26 from synchronized motor means 27. The wheels on each of said resilient wheel drives are spaced apart to grasp closures and push said closures through entrance 12. The resilient wheel drives are secured to enclosure 15 by bolts 30. A second pushing means or resilient wheel drive may be placed at each exit 13 of dryer 10 to minimize the back pressure placed on closures traveling through the dryer. A second wheel drive should only be necessary where closures must travel a significant length of trackwork to the operation subsequent to the dryer.

Figure 6:
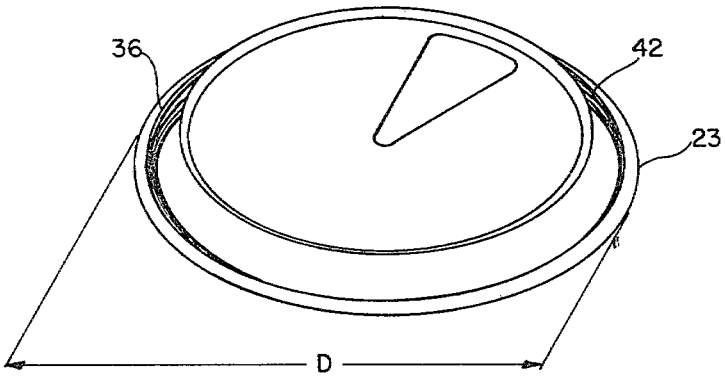
FIG. 6 is a typical closure operated on by the dryer.

A typical closure 23 to be operated on by the present invention is shown in FIG. 6. Said closure has a flange 36 around the outer periphery thereof, and a bead of sealant 42 adjacent to said flange. A series of closures 23 may be introduced to resilient wheel drive 22, each closure being indexed forward by said wheel drive and pushed through the trackwork by subsequently introduced and indexed forward closures. Any conventional means may be used to introduce closures to resilient wheel drive 22, such as downward sloping trackwork, or a conveyor with vacuum assist directly from a sealant applicator.

Figure 4:
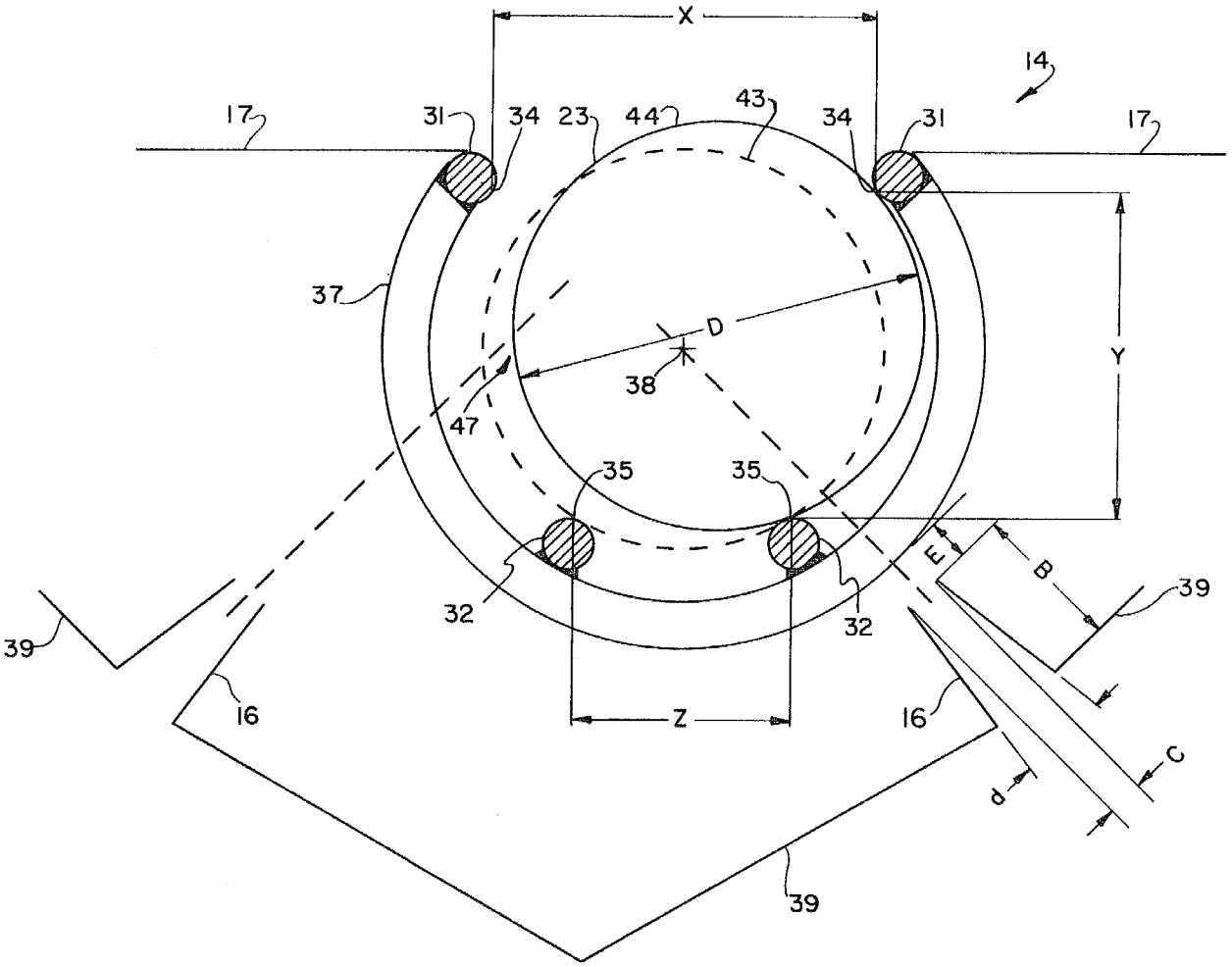
FIG. 4 is a detailed cross-sectional view of the trackwork of the dryer.
Figure 5:
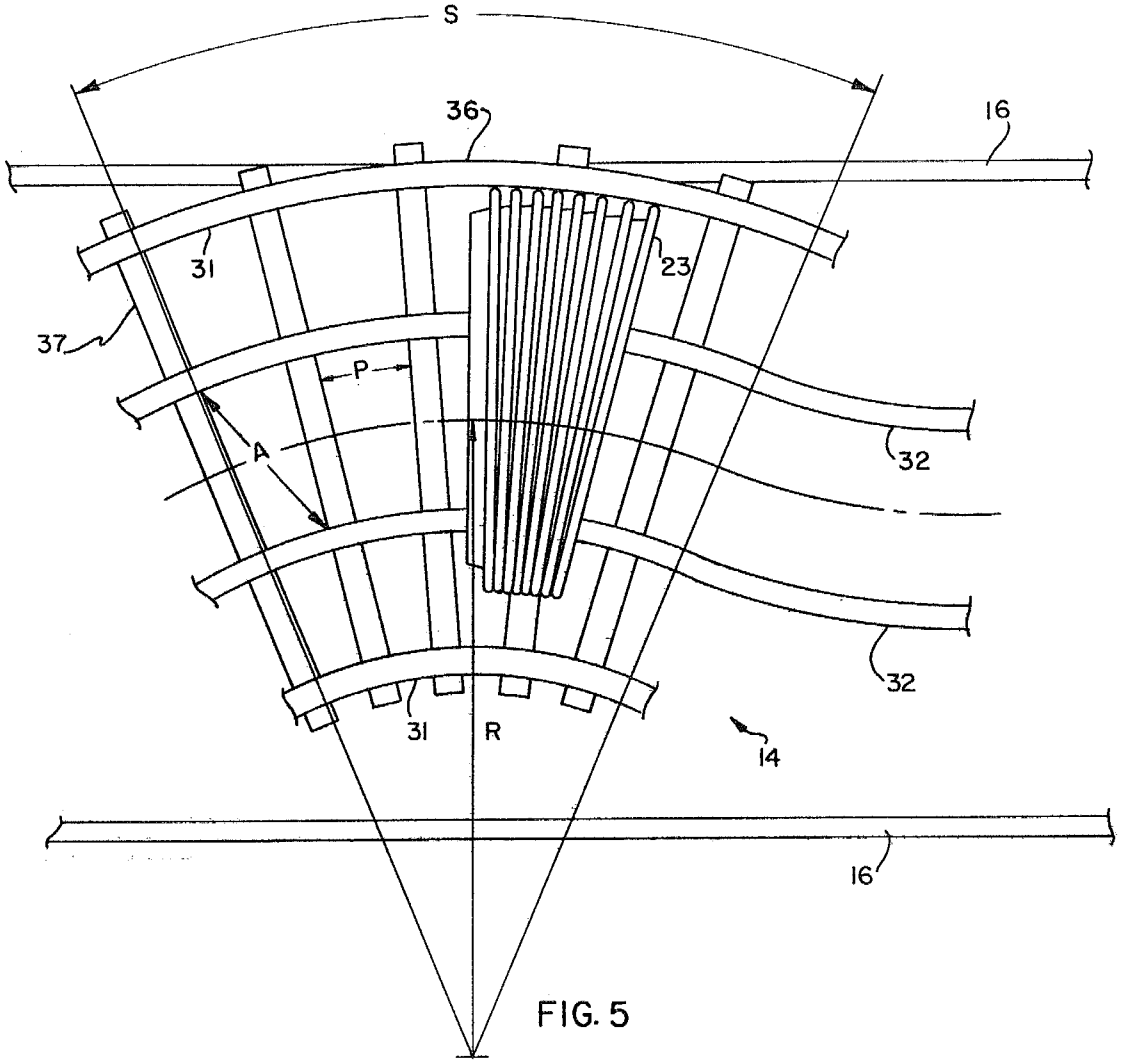
FIG. 5 is a top view corresponding to the cross-sectional view of FIG. 4.

The trackwork construction is shown in FIG. 4 which is a cross-sectional end view of trackwork 14 at line 4—4 of FIG. 1. Corresponding to end view FIG. 4 is top view FIG. 5 illustrating closures 23 traversing the curve of line 4—4 in FIG. 1.

The trackwork of the preferred embodiment is constructed of two upper rails 31, two lower rails 32 and a series of retainers 37 which secure the rails in appropriate spaced relationship and provide the added function of preventing closures from dropping through the trackwork. Only a portion of trackwork 14 is illustrated as trackwork 24 is of similar construction and the configuration of the remaining portions of both trackworks will be readily apparent from the drawings and description.

A number of other trackwork designs may be operable with the present invention including configurations having various numbers of rails and retainers as long as the trackwork maintains the orientation of the articles at a constant relative to the direction of travel, allows free movement of treating medium to reach the articles, and has a nominal coefficient of friction with the articles.

It has been found that a four-rail system, with the to be described configuration, is ideal in minimizing friction and jamming, allowing free movement of air and separating the articles. In the preferred embodiment, upper rails 31 are spaced such that upper contact surfaces 34 are X distance apart and positioned in a first horizontal plane, lower rails 32 are spaced such that lower contact surfaces 35 are Z distance apart and positioned in a second horizontal plane, said first and second horizontal plane being substantially parallel and having a perpendicular distance of Y between them. Where closure 23 (FIG. 6), which is to be operated on by the present invention, has a diameter of D, distance X is preferably between about 0.89D and 0.99D, distance Z is between about 0.45D and 0.55D, and distance Y is between about 0.77D and 0.87D. Empirical testing has yielded excellent results where X is 0.95D, Y is 0.82D and Z is 0.50D inches.

The configuration of the preferred embodiment is advantageous in minimizing friction and jamming of closures. This is achieved by supporting closures traversing the trackwork with a maximum of two contact surfaces, both of said surfaces being on the same side of the closure. Dotted line 43 of FIG. 4 illustrates the position of a closure traveling along a straight section of the trackwork while FIGS. 3 and 7, which are, respectively, cross-sectional views of the left curve at line 3—3 and the right curve of line 7—7 of FIG. 1, illustrate a closure traversing curves in both directions. Empirical testing of this design has shown that, when constructed in accordance with the above-disclosed parameters, frictional forces are nominal and jamming is virtually nonexistent.

The radius R and sector S of curves in trackwork 14 are interrelated in that a decrease in radius will allow greater airflow through the closures while an increase in sector will hold the closures open over a greater length of time, thereby providing greater drying. A conflicting consideration is the increased friction which results as the radius is decreased or the sector is increased. To achieve sufficient drying while minimizing friction it has been found best to use a series of reversing curves having relatively small sectors of between 35 and 55 degrees. Satisfactory results have been obtained in production line tests using seven curves of a center radius of about three times the diameter of the closures operated on and having a sector of about 45°. This results in a separation of between 1/16 and 3/16 of an inch between adjacent closures when traversing a curve. Friction may also be lowered and greater fanning of closures achieved by attaching a high-frequency, low-amplitude vibrator 33 to the trackwork. Due to the increased risks of fatigue and other problems which may result from exposure to vibration, it is thought undesirable to use such a vibrator unless necessary to obtain sufficient drying.

A variety of other curve designs are contemplated by the present invention including reversing curves in a vertical plane and a descending spiral curve. The preferred embodiment is designed to fit directly into existing closure lines without upstream or downstream modifications.

A significant feature of the present invention which makes production line operation substantially trouble-free are the retainers best shown in FIGS. 4 and 5. These retainers are spaced a maximum distance of P apart such that distance A is less than 2/3D where D is the diameter of the closures. To achieve maximum drying it is desirable to minimize interference of airflow from nozzle 16. However, where a rail system is used alone without retainers 37, the startup or stoppage of a production line operation may result in some of the closures becoming unstacked and falling through the trackwork. This can result in jams and spills thereby requiring costly delays and corrective action. It has been found that retainers with the spacing disclosed herein allow startup of a line even when closures are scattered throughout the trackwork and lying down therein. Any closer spacing detracts from the drying by obstructing air from nozzle 16, while greater spacing than that disclosed may result in jamming or spillage when starting up the dryer after closures become unstacked.

Figure 3:
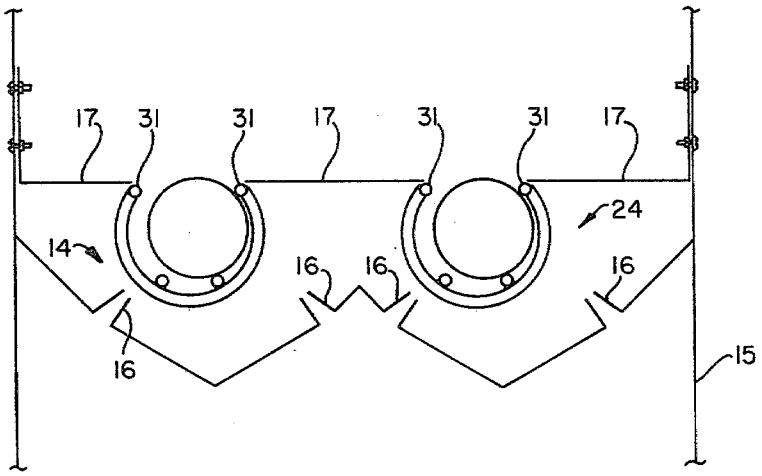
FIG. 3 is a cross-sectional view of a closure traversing the outermost portion of a curve in a first direction in the dryer.
Figure 7:
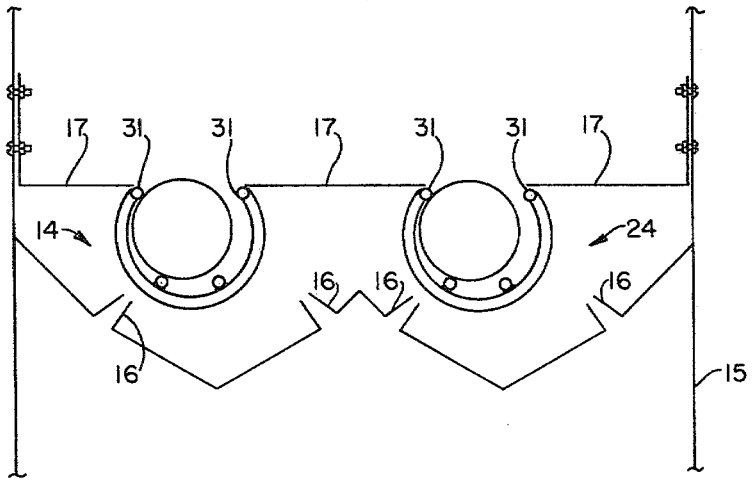
FIG. 7 is a cross-sectional view of a closure traversing a curve in an opposite direction to that of FIG. 3.

As shown in FIGS. 3 and 7, a planar baffle 17 rests on and extends outwardly from the upper rails 31 of each trackwork, said baffle extending between both trackworks and being connected to enclosure 15. This baffle increases the energy-efficient operation of the dryer by helping direct the airflow between the open portions of the closures.

Two linear nozzles 16 are positioned below and to the sides of each trackwork, said nozzles having a taper angle of d, a length of B, and an opening width of C. Preferably said nozzles are directed at a 45° angle from vertical toward the longitudinal axis of the trackwork at the points said linear nozzle forms a tangent to and is in its closest position to said trackwork, one of said points being referenced as 36 in FIG. 5. In a trackwork constructed in accordance with the herein specified parameters, the linear nozzle provides the additional function of rotating closures which are traversing the curves. As shown in FIG. 4, which is a cross-sectional view of trackwork 14 at the outermost point of a curve, the nozzle positioned on the inside of the curve directs a stream of air to impinge the closure tangentially at area 47. This generates tangential forces which cause clockwise rotation of the closure. Closures traversing curves in the opposite direction to that shown in FIG. 4 are rotated counterclockwise by the opposite linear nozzle. Greater uniformity in drying is achieved if the closure is rotated at least once in traversing a curve.

A variety of different fans and heaters may be utilized with the dryer depending on the line speed, amount of sealant on the closures, and the drying desired. Generally, best results will be achieved if a sufficient airflow is created to result in an air speed of about 4,000 feet per minute at the nozzle. This provides good penetration of air into the stack of closures and assures rotation of the closures by the inside nozzle.

It has been found that a dryer having four-foot track sections and one-inch insulated walls, that is constructed in accordance with the above parameters for 2.73 inch diameter closures, can be heated to above 200° F. with a 12 kw heater while two lanes of closures are being dryed at up to 380 closures per minute per lane. Generally, closures having between 40 and 80 miligrams of water soluble sealant on them, which is about 65 percent total solids, will be dryed to in excess of 97 percent total solids by the dryer if the air in the hot air receiving compartment is above 190° F. and vibrator 33 is not used. With most commercially available water-borne sealant compounds, drying to 95 percent total solids, and preferably 97 percent, is sufficient for application of the closure to a canbody.

INDUSTRIAL APPLICATION

The present invention has industrial application in the metal beverage container industry.

What is claimed is:

1. Apparatus for treating articles comprising: a plurality of spaced apart rails between which a stack of articles, set on edge, in abutting face-to-face contact are confined, said rails being disposed relative to one another so as to define a curved path of substantially constant width; a means for pushing said stack longitudinally within the confines of said rails whereby the portions of adjacent articles in proximity to the rail of greater radius of curvature are spaced from one another; and means for directing a treating medium between said spaced article portions.

2. The apparatus of claim 1 including a series of retainers surrounding at least the lower 180° of said path, said retainers being longitudinally spaced such that no opening greater than ⅔ the diameter of said article is presented to said path.

3. Apparatus for exposing and drying the surfaces of a series of disc-shaped articles in abutting face-to-face contact comprising: a plurality of parallel guide surfaces defining a curved path for guiding said articles on edge therethrough; means for advancing said articles along said path; a series of retaining surfaces located longitudinally along said path, said retaining surfaces being spaced to prevent an opening greater than ⅔ the diameter of said disc-shaped articles from being presented to said path; and means for directing air over the outer radius of said curved path.

4. Apparatus for exposing and drying the surfaces of a series of disc-shaped articles in abutting face-to-face contact comprising: a plurality of parallel guide surfaces defining a curved path for guiding said articles, set on edge, therethrough; a series of retaining surfaces located longitudinally along said path, said retaining surfaces being spaced to prevent an opening greater than ⅔ the diameter of said disc-shaped articles from being presented to said path; means for directing air over the outer radius of said curved path; and means to rotate said disc-shaped articles while traversing said path wherein said means to rotate is a high velocity air nozzle directed to impinge said disc-shaped articles tangentially.

5. The apparatus of claim 4 including a high-frequency, low-amplitude vibrator attached to said plurality of parallel guide surfaces.

6. Apparatus for exposing and drying a plurality of closures in abutting face-to-face contact comprising: a plurality of guide members defining a path having a series of connected reversing curves, said guide members presenting said path with a plurality of smooth parallel guide surfaces for confining said stack of closures, set on edge, to travel therethrough, a means to engage and push said stack through said path; and a means to direct air substantially perpendicular to said path at the outer portions of said curves to thereby contact the faces of said closures.

7. Apparatus for exposing and drying a plurality of closures in abutting face-to-face contact comprising: a plurality of guide members defining a path having a series of connected reversing curves, said guide members presenting said path with a plurality of smooth parallel guide surfaces for confining said stack of closures to travel therethrough and wherein said plurality of guide members comprise at least four rails presenting said path with at least four smooth parallel guide surfaces wherein two of said guide surfaces are in an upper substantially horizontal plane and spaced between about 0.89 and 0.99 of the diameter of a closure apart and two of said guide surfaces are in a lower substantially horizontal plane and spaced between about 0.45 and 0.55 of the diameter of a closure apart, said guide surfaces having horizontal symmetry about said path, said upper and lower substantially horizontal planes having a perpendicular distance between them of between about 0.77 and 0.87 of the diameter of a closure; a means to engage and push said stack through said path; and a means to direct air substantially perpendicular to said path at the outer portions of said curves.

8. The apparatus of claim 7 wherein each of said curves have a radius of between about 2.50 and 3.75 of the diameter of a closure and each of said curves covers a sector of between about 35° and about 55°.

9. The apparatus of claim 8 including a high-frequency, low-amplitude vibrator attached to said rails.

10. Apparatus for exposing and drying a series of closures in abutting face-to-face contact comprising: a trackwork through a drying station, said trackwork having a series of substantially uniform reversing curves; a linear nozzle running along each side of said trackwork, said nozzles directed toward the longitudinal axis of said trackwork at the points said nozzles are at a tangent to said trackwork; an air blowing and heating means in communication with said nozzles; and a means to push closures into said trackwork wherein said closures are oriented in a plane substantially perpendicular to said trackwork.

11. Apparatus for exposing and drying a series of closures in abutting face-to-face contact comprising: a trackwork through a drying station, said trackwork having a series of substantially uniform reversing curves, each of said curves having a center radius of about three times the diameter of a closure and covering a sector of about 45°; a linear nozzle positioned on each side and running the length of said trackwork, said nozzles directed upward at about a 45° angle from vertical toward the longitudinal axis of said trackwork at the points said trackwork is at a tangent to said nozzles; an air blowing and heating means in communication with said linear nozzles; and means to push closures into said trackwork, wherein said closures are oriented in a plane substantially perpendicular to said trackwork, and whereby closures traversing the curved portion of said trackwork will be tangentially impinged by air directed from the nozzle opposite said curve resulting in rotation of said closures.

12. The apparatus of claim 11 wherein said trackwork has at least four guide members, said guide members having smooth parallel inner guide surfaces wherein two of said guide surfaces are in an upper substantially horizontal plane and spaced between about 0.89 and 0.99 of the diameter of a closure apart and two of said guide surfaces are in a lower substantially horizontal plane and spaced between about 0.45 and 0.55 of the diameter of a closure apart, said guide surfaces having horizontal symmetry about said path, said upper and lower substantially horizontal planes having a perpendicular distance between them of between about 0.77 and 0.87 of the diameter of a closure.

13. The apparatus of claim 12 including a high-frequency, low-amplitude vibrator attached to said guide surfaces.

14. The apparatus of claim 13 including an insulated enclosure surrounding said drying station, said enclosure having a lower hot-air receiving compartment, the outlet of said compartment being said linear nozzle, and a planar baffle member extending outwardly from the upper guide surfaces of said trackwork to said enclosure.

15. Apparatus as described in claim 14 wherein said means to push a stack of closures is a dual synchronized resilient wheel system, said resilient wheels located at the beginning of said trackwork, said wheels constructed to engage and index forward a closure when introduced thereto whereby closures in said trackwork will be continuously pushed forward by following closures introduced to and indexed forward by said wheel system.

16. A method of treating the unexposed surfaces of articles in a stack, comprising the steps of, transporting the stack of articles, set on edge, through a curvilinear path whereby the surfaces of the articles are exposed and directing treating medium over said articles while so transporting.

17. A method of exposing and treating the major portion of the abutting surfaces of a plurality of planar articles in face-to-face contact, comprising the steps of: pushing said plurality of articles, set on edge, along a curvilinear path such that each of said articles in said path derive their motive force from contact with the following article and likewise provide motive force to the preceding article through contact therewith; maintaining the orientation of said articles relative to the direction of travel at substantially a constant whereby said articles will traverse said path in a fan-like manner exposing the major portion of said planar articles; and directing treating medium toward said exposed major portion of said articles.

18. A method of treating the surfaces of a plurality of circular articles, set on edge, comprising the steps of: accumulating a linear stack of said articles, deflecting said stack to a curvilinear orientation whereby the portions of said articles on the outer radius of said curvilinear orientation will separate in a fan-like manner while the portions of said articles along the inner radius of said curvilinear orientation will remain in contact; positioning a treating means adjacent said outer radius; and directing treating medium toward said articles from said treating means.

19. A method of drying the coatings on closures comprising the steps of: continuously introducing closures, set on edge, into a drying station; allowing each of said closures to be pushed through said drying station by subsequently introduced closures; guiding said closures along a curvilinear path so as to expose said coatings; and directing heated air across the greater radius portion of said curvilinear path.

20. A method of drying the coatings on closures comprising the steps of: continuously introducing closures, set on edge, into a drying station; allowing each of said closures to be pushed through said drying station by subsequently introduced closures; guiding said closures along a curvilinear path; rotating said closures; and directing heated air across the greater radius portion of said curvilinear path.

21. A method of drying the coating on a closure comprising the steps of: accumulating a stack of closures; supporting said closures at spaced apart points; restraining said closures to substantially planar movement; pushing said stack of closures, set on edge, through a drying station; guiding said stack through a series of substantially uniform reversing curves; directing heated air over the outer radius portions of said curves so as to contact said coating; and rotating closures as they traverse a curve.

22. A method of drying the surfaces of a series of closures comprising the steps of: continuously introducing closures to a drying station; guiding said closures through a series of substantially uniform reversing curves with a trackwork, said closures being oriented in a plane substantially perpendicular to said trackwork; allowing each closure to be pushed through said drying station by subsequently introduced closures; maintaining the orientation of each closure at a substantially constant relative to the direction of travel; providing a linear nozzle along each side of said curves; directing high-velocity heated air toward said closures through said linear nozzles; and allowing rotation of said closures while being guided through said curves by tangential impingement of said closures with the high-velocity air directed from the linear nozzle on the shorter radius side of said curves.

23. The method of claim 22 including vibrating said closures through a high-frequency, low-amplitude vibrator attached to said trackwork.

* * * * *